United States Patent [19]

Tripp et al.

[11] Patent Number: 4,498,365

[45] Date of Patent: Feb. 12, 1985

[54] APPARATUS FOR PROVIDING EXTENDED VERSATILITY IN A KEYBOARD-CONTROLLED MUSICAL INSTRUMENT IN PITCH VARIATION, TONE ALTERATION CHARACTERISTICS AND THE LIKE

[76] Inventors: Jeff Tripp, 35 Squam Rd., Rockport, Mass. 01966; John Allen, 10 Farragut St., Somerville, Mass. 02144; F. Merrick Murphy, 40 Rugg Rd., Allston, Mass. 02134

[21] Appl. No.: 541,915

[22] Filed: Oct. 14, 1983

[51] Int. Cl.[3] ..... G10H 1/02; G10H 1/34

[52] U.S. Cl. ..... 84/1.24; 84/433; 84/DIG. 7

[58] Field of Search ..... 84/1.04, 1.06–1.1, 84/1.14–1.16, 1.24, 1.25, 216, 423 R, 433, 439, DIG. 7

[56] References Cited

U.S. PATENT DOCUMENTS

| | | | |
|---|---|---|---|
| 1,853,630 | 4/1932 | Martenot | 84/1.25 |
| 1,914,831 | 6/1933 | Martenot | 84/1.25 X |
| 3,681,507 | 8/1972 | Slaats et al. | 84/1.24 X |
| 3,693,492 | 9/1972 | Ohno | 84/1.25 X |
| 3,715,447 | 2/1973 | Ohno | 84/1.24 |
| 4,068,552 | 1/1978 | Allen | 84/1.06 |
| 4,347,772 | 9/1982 | Nishimoto | 84/1.24 X |

*Primary Examiner*—S. J. Witkowski

*Attorney, Agent, or Firm*—Rines and Rines; Shapiro and Shapiro

[57] ABSTRACT

A keyboard-operated tone-producing apparatus having, in combination, keyboard means the keys of which are mounted for downward depression to effect tone production in the apparatus and for longitudinal sliding to alter or bend the tone; electronic digital signal processor means; tone-generating means; pressure sensing means responsive to key depression to produce signals corresponding thereto for application to the signal processor means to produce corresponding digital signals applied to generate tones from the tone-generating means; means for causing the pressure sensing means to provide the same signal reference, upon key depression, irrespective of the point of pressure along the path of longitudinal sliding of the key; and means controlled in response to the last-named means and cooperative with the signal processor means as it controls the tone-generating means to produce one or all of variable range bending of the tone, center compensation for differing player techniques of key depression, and second striking of the key while depressed for second tone generation.

13 Claims, 7 Drawing Figures

APPARATUS FOR PROVIDING EXTENDED VERSATILITY IN A KEYBOARD-CONTROLLED MUSICAL INSTRUMENT IN PITCH VARIATION, TONE ALTERATION CHARACTERISTICS AND THE LIKE

The present invention relates to apparatus for producing pitch variation, tone (including timbre) alteration and related effects in musical instruments and the like, being more particularly directed to a keyboard instrument wherein sound is produced by depression of an individual longitudinally extending key of the keyboard and modified by displacement longitudinally backward and forward in the plane of the key and certain extended versatilities of the instrument such as variable range of pitch bending, center compensation for individual players characteristics of key depression, and enabling second striking of the key by further pressure.

The present state of the art in keyboard musical instruments ranges from those instruments in which a constant pitch is created by each individual key and those instruments in which a vibrato effect may be created by a horizontal oscillation of blocks of keys, as disclosed, for example, in U.S. Pat. Nos. 1,853,630 and 1,914,931, to instruments in which pitch variation or note-bending is achieved by longitudinal displacement of a depressed key, as disclosed in U.S. Pat. No. 4,068,552. Each of these systems, and others, require substantial ear-hand feedback control for the player as well as limiting player ability to use more than one prearranged effect during a performance with little or no provision provided for personalized setting of control ranges for the various effects.

An object of the invention is to provide a novel apparatus that does not have the aforementioned limitations and provides for a variable range of effects such as pitch bending, to be produced.

Another object is to provide a novel apparatus for center compensation for individual players characteristics of key depression.

A further object is to provide a novel apparatus for enabling and disabling additional effects during the the continuation of one or more occurring effects, such as re-striking a "bent" or pitch variant note.

A still further object is to provide a novel apparatus for displacement compensation for individual player characteristics of involuntary key displacement.

Other and further objects will be explained hereinafter and are more particularly delineated in the appended claims.

In summary, however, from one of its broad aspects, the invention contemplates a novel keyboard-operated tone-producing apparatus having, in combination, keyboard means the keys of which are mounted for downward depression to effect tone production in the apparatus and for longitudinal sliding to alter or bend the tone; electronic digital signal processor means; tone-generating means; pressure sensing means responsive to key depression to produce signals corresponding thereto for application to the signal processor means to produce corresponding digital signals applied to generate tones from the tone-generating means; means for causing the pressure sensing means to provide the same signal reference, upon key depression, irrespective of the point of pressure along the path of longitudinal sliding of the key; and means controlled in response to the last-named means and cooperative with the signal processor means as it controls the tone-generating means to produce one or all of variable range bending of the tone, center compensation for differing player techniques of key depression, and second striking of the key while depressed for second tone generation. Preferred details and structures are hereinafter more particularly described.

The invention will now be described with reference to the accompanying drawings in which.

Figure 1:
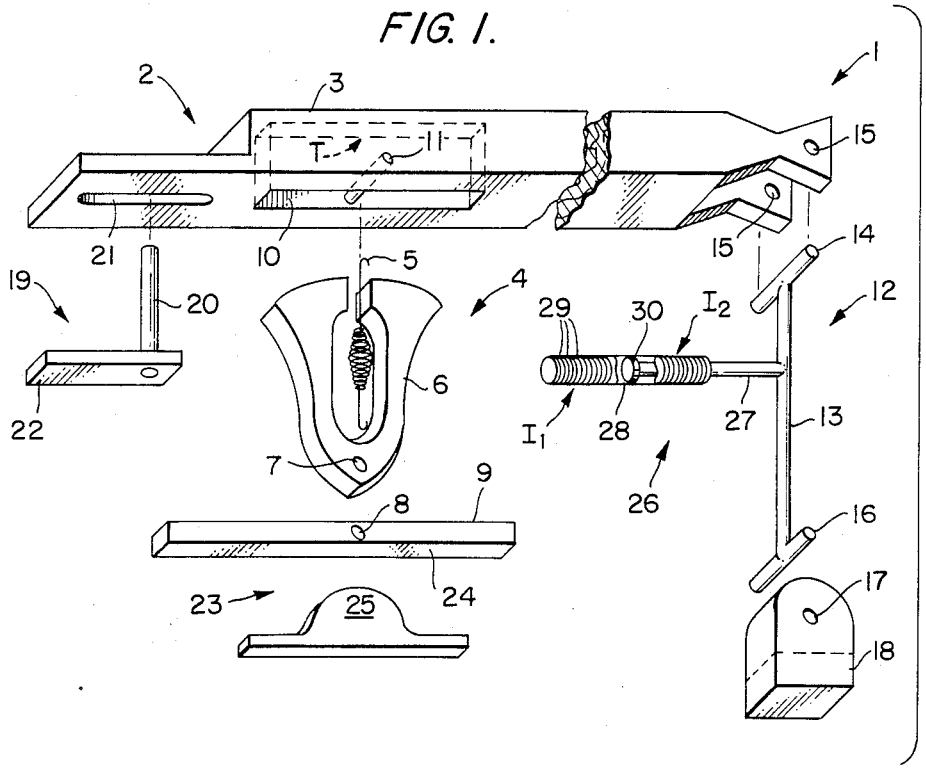
FIG. 1 is an exploded view of a pressure and longitudinal sensor arrangement coupled to a longitudinally displaceable key.

In the embodiment of FIG. 1, the number 1 refers to a key system of a tone producing apparatus, having a key 2 with both longitudinal displacement and pressure sensors attached therewith. The key 2 has a playing surface 3 which is used for depressing the key 2 onto the pressure sensor and longitudinally displacing the key 2. The key 2 is centrally supported by a rocker assembly 4 composed of a coil spring 5 located within a rocker body 6. The rocker body has an upper curved portion for providing a rolling or rocker motion and a tapering lower portion having a hole 7 at a point furthest from the key 2 to be aligned with a hole 8 of a leaf spring 9 which is secured to the frame (not shown) of the keyboard tone producing apparatus. With the hole 7 and the hole 8 concentrically aligned, a pin member (not shown) may be inserted through the aligned holes 7 and 8 to secure the rocker 4 to the leaf spring 9 and therefore to the frame of the apparatus.

The key 2 has an internal slot 10 for receiving a portion of the rocker 4, and a pin 11 extending transversely through the slot 10 for attachment to the coil spring 5 of the rocker assembly 4. The other end of the coil spring 5 is attached to the pin member (not shown) that connects the rocker 4 to the leaf spring 9 through aligned holes 7 and 8 such that in a non-longitudinally displaced key 2 position, the point of contact of the coil spring 5 at the pin through holes 7 and 8, pin 11 and a point T, that is directly and linearly above the contact point of the coil spring 5 and the pin 11, are all linearly aligned. The coil spring 5 has a length less than the radius of curvature of the upper portion of the rocker body 6 such that when the key 2 is displaced longitudinally the three linearly aligned points (point T, and the coil spring 5 contact points at pin 11 and at holes 7 and 8) will be displaced out of alignment, causing the coil spring 5 to produce a restoring force to re-align the key 2 in a non-longitudinally displaced position.

The key 2, at one end, is additionally supported by a second rocker assembly 12, composed of a generally perpendicularly extending cylindrical member 13 with an integral pin portion 14 at one end of the cylindrical member 12, that is inserted into holes 15 of the key 2. The other end of the cylindrical member 13 has an integral pin portion 16 that is inserted into the holes 17 of bracket 18 which is secured to the frame (not shown) of the keyboard tone producing apparatus. The pin members 14 and 16 are generally formed as mutually parallel, non-skewed pin segments and each are attached to the cylindrical member 13 at a 90° angle at their respective midpoints. The bracket 18 is secured to the frame in such a manner that when the key 2 is in a non-longitudinally displaced position, the longitudinally extending cylindrical member 13 of the second rocker assembly 12 is essentially perpendicular to the key 2 and the pin members 14 and 16 are pinned perpendicular to the direction of longitudinal displacement of the key.

Additionally, the longitudinal displacement of the key 2 is limited by stop member 19 which is composed of a perpendicularly extending pin member 20, that is inserted into a slot 21 in the key 2, which is secured to a base member 22, in turn is secured to the frame (not shown) of the tone producing apparatus. Therefore, with the described arrangement, the rocker assembly 4 and the second rocker assembly 12 secure the key 2 to the frame of the keyboard tone producing apparatus while providing for limited longitudinal displacement of the key 2.

The key system 1 has a pressure sensor apparatus, generally designated by the number 23, for providing a reference signal at any point within the path of longitudinal displacement of the key 2, once the key 2 has been depressed. The pressure sensor apparatus includes the rocker assembly 4 connected to an electrically conductive leaf spring 9. The leaf spring 9 has a layer of dielectric material such as a 2 mil thickness of "Thermalfilm" produced by Thermalloy Co., Dallas, Tex., adhered to the surface of the leaf spring 9 furthest from the key 2, such as at surface 24, and separating the electrically conductive leaf spring 9 from a variable thickness or tapered pad of electrically conductive deformable material, such as conductive rubber pad 25. The leaf spring 9 and the conductive pad 25 act as two plates of a capacitor, which is a portion of a signal reference circuit (not shown), such that sufficient proximity between the spring 9 and the pad 25 will exceed a threshold capacitance and be regarded as a striking of the key 2. Additionally, when sufficient downward force is placed on the key 2, the force will be transmitted to the spring 9, and the dielectric material at 24, compressing the tapered rubber pad 25. As the variable width or tapered rubber pad 25 is compressed, a greater surface area of the conductive rubber is brought into close proximity with the spring 9 and therefore a greater capacitance effect, producing different signal results proportionate to the pressure on the key 2. Additionally, since the pressure sensor apparatus 23 includes the rocker assembly 4 and the plates of the sensor capacitor (spring 9 and pad 25) are secured in the same position irrespective of longitudinal motion of the key 2, the pressure sensor will provide the same signal reference to pressure at any point within the path of longitudinal displacement of the key, once the key has been depressed.

The key system 1 is also provided with a longitudinal displacement sensor generally designated by the number 26. The longitudinal displacement sensor 26 includes a non-conductive cylindrical push-rod 27 securely connected to the longitudinally extending cylindrical member 13 of the second rocker assembly 12 such that the push-rod 27 extends generally parallel to the body of the key 2 and perpendicular to the cylindrical member 13. Concentrically disposed about the push-rod 27 is a nonconductive cylindrical sleeve 28, shown partially cut away for interior detail, that is wrapped by conductive wire 29 to form two co-linear, linearly displaced equal magnitude inductors $I_1$ and $I_2$ which form part of a signal reference circuit of well-known types (not shown). Inside the cylindrical sleeve 28, the push-rod 27 is concentrically connected to a conductive member, such as a cylindrical shaped ferrite slug 30, such that the push-rod 27 and slug 30 can move longitudinally within the sleeve 28.

When the key 2 is in a non-longitudinally displaced position, the slug 30 is supported by the push-rod 27 in connection with the second rocker assembly 12 at a position between the two inductors $I_1$ and $I_2$. Since the inductors $I_1$ and $I_2$ have the same base inductance, a signal passing through the inductors $I_1$ and $I_2$ and therefore to the signal reference circuitry is balanced when the key 2 is not displaced. When the key 2 is longitudinally displaced, however, the ferrite slug 30 is proportionally longitudinally displaced within the sleeve 28 and increases the inductance of the inductor $I_1$ or $I_2$ where the ferrite slug 30 is located. When the inductance of one of the inductors $I_1$ and $I_2$ is increased, it produces a proportional decrease in the signal passing through the affected inductor $I_1$ or $I_2$ and a proportional increase in the opposing inductor $I_2$ or $I_1$, such unbalanced signal being sensed by the signal reference circuit. Therefore the longitudinal displacement sensor 26, coupled with the second rocker assembly 12, provides a variable reluctance system that creates a signal proportional to the longitudinal displacement of the key 2.

Figure 2:
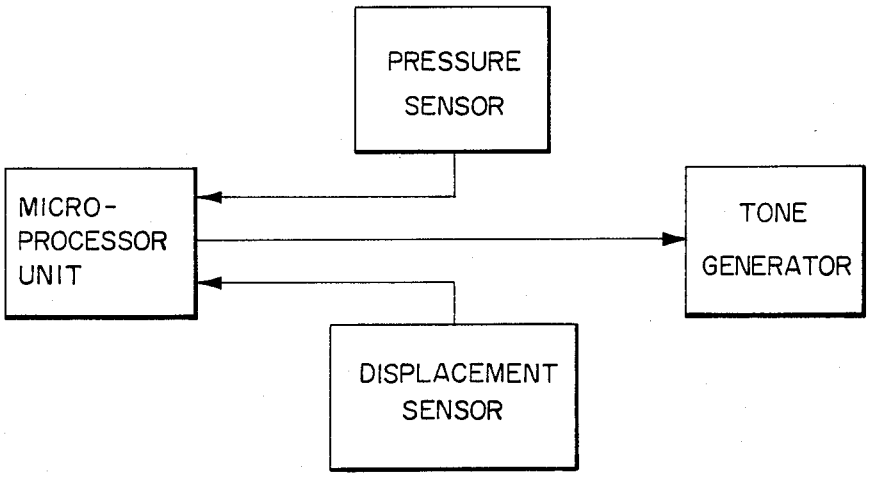
FIG. 2 is a block diagram showing the relationship between the sensors, electronic processor and tone generator.

Referring now to FIG. 2, the pressure sensor and displacement sensor, including sufficient circuitry to form a signal reference circuit for each sensor, are connected to an electronic digital processing means, such as a microprocessing unit (MPU). The microprocessing unit accepts the signal references from the pressure and displacement sensors for each key and provides a reference signal to a tone (sound) generating circuit. Due to the nature of the novel pressure sensor which provides the same signal reference to pressure at any point within the path of longitudinal displacement of the key coupled with the electronic digital processing means, which receives signals as to the longitudinal displacement of the key, certain novel and unexpected advantages occur.

Figure 4:
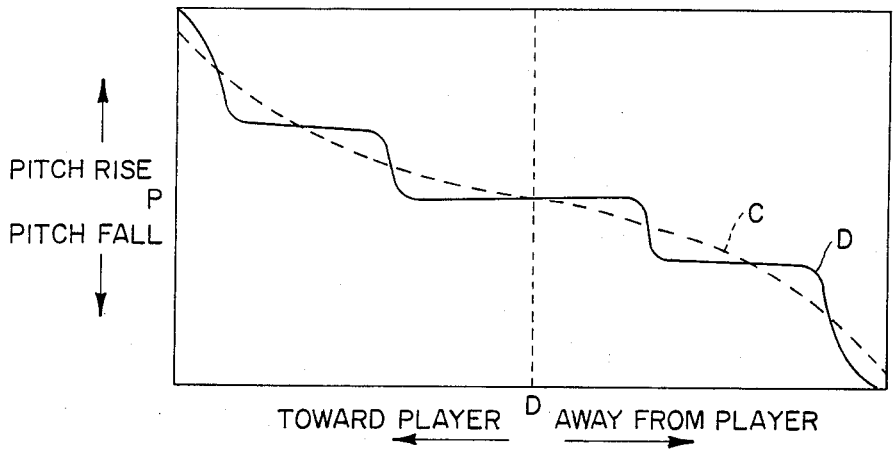
FIGS. 3, 4, 5 and 7 are graphs illustrating relationships between distance of key motion and pitch variation according to the present invention.
Figure 3:
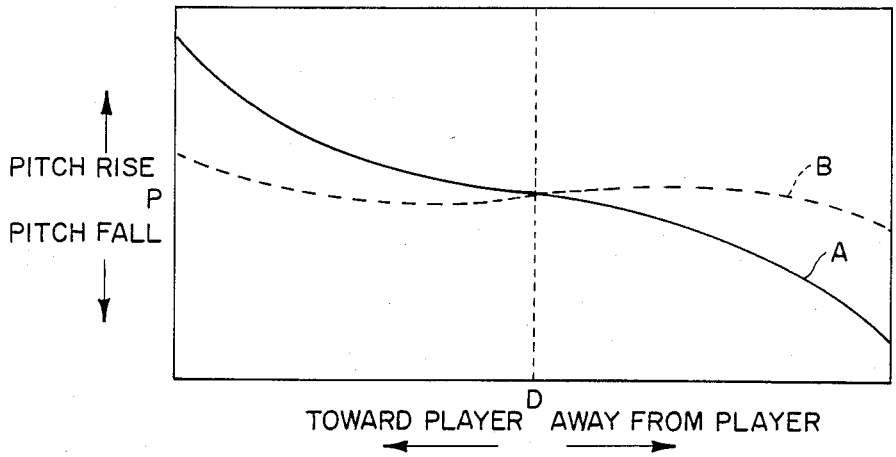

One such advantage is that the range of pitch bending that occurs over a given longitudinal displacement may be varied without reconstruction of the instrument. FIGS. 3 and 4 illustrate by way of example a relationship between distance D, as the key moves longitudinally, and the corresponding change in the musical pitch P or other controlled variable. In FIG. 3, a first gradual proportional relationship shown as curve A can be re-set, without hard-ware modification or replacement of electronic or mechanical parts, to provide a gradual proportional note bending relationship as shown in curve B where the same longitudinal displacement of the key 2 provides a lower degree of pitch variation or note bending. Additionally, as shown in FIG. 4, complex relationships may be included or substituted for simple displacement-note bending relationships.

A second advantage allows for center compensation for individual players' characteristics of key depression. Specifically, although the keys are designed to be normally struck or actuated by a downward force, without longitudinal displacement (although a player may displace the key prior to activation to produce an originally bent note), an individual player may inadvertently strike a key causing longitudinal displacement and subsequent inadvertent note bending. However, with the novel configuration of the present invention, the user may strike the key prior to normal operation to determine the user's individual inadvertent displacement characteristics. Subsequently, the system will adjust the displacement-note bending relationship to best suit the user. For example, in FIG. 5, a player has chosen a directly linear displacement-note bending relationship shown as line F with specific maximum changes in pitch for each maximum displacement. Providing the player strikes the key without longitudinal displacement, the point of contact of note generation would be at point E, with the displacement-note bending relationship as shown in curve F. However, the player may tend to draw that key somewhat towards himself, which would normally result in the generation of an inadvertent bent note. Therefore, to compensate for this inadvertent displacement, the player strikes the key prior to playing the instrument and finds that normal downward motion produces a displacement as shown by the point G. The system compensates for this inadvertent displacement by fitting the curve to the required maximum-minimum and proportional-displacement-pitch variation criteria and produces a fitted curve H for actual playing. At this time, when curve H represents the existing displacement-note bending relationship, if the key is struck without any longitudinal displacement, as shown by point J, a bent note with lower pitch will be created. A flow chart showing the procedure for initializing the key offset and range for use with a display output for the MPU is included as FIG. 6.

A third advantage enables secondary triggering of the key 2, for example, to re-activate or re-strike the key 2 without removing pressure from the key 2 during operation. Specifically, a second threshold level of capacitance can be defined for the pressure sensor 23 to retrigger the key, such that sufficient downward force will compress the pad 25, thereby increasing the capacitance of the pressure sensor 23 and providing a signal above the designated second threshold level.

Additionally, since the microprocessor unit samples the signals provided by the pressure sensor at preselected intervals, separate effects can be produced depending on the relative speed of pressure increase or decrease. For example, a rapid release of pressure on the key might be interpreted, through proper instructional coding, as a desired release of the key 2. As predefined, the intended release of pressure would suggest that even though the restoring force provided by the rocker assembly 4 will move the key 2 back to a center non-longitudinally displaced position, the tone (sound) desired is the tone that was being produced prior to any rapid pressure release. Therefore, rapid key release will provide the same tone during decay that was produced prior to release; yet slow pressure release would still allow continual note bending characteristics during longitudinal displacement. Also, the speed of initial pressure can be sampled to provide additional tonal characteristics, such as providing a volume of initial note attack directly proportional to the speed of initial contacting pressure.

Figure 5:
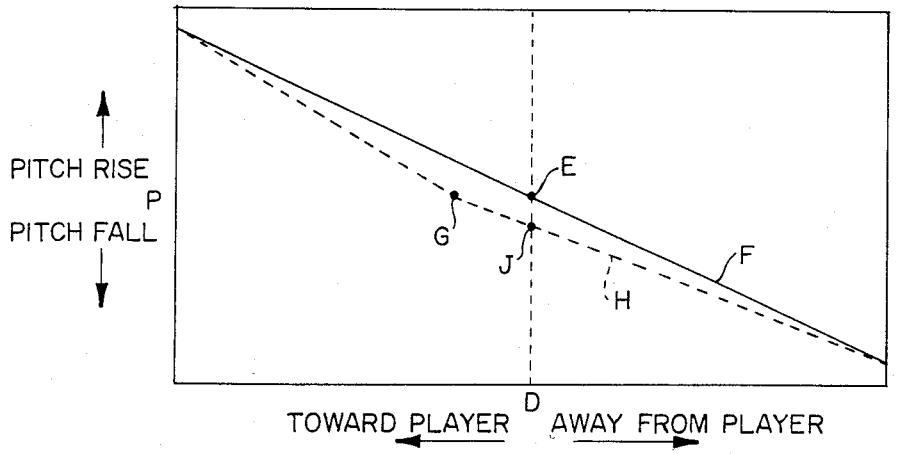
Figure 7:
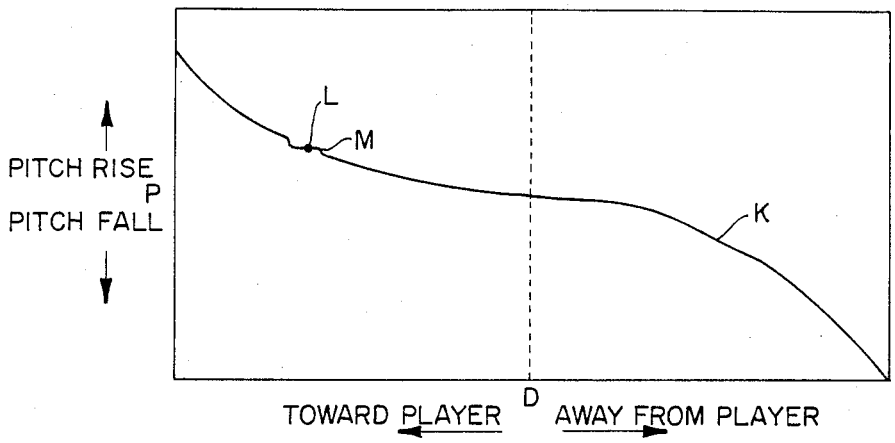
Figure 6:
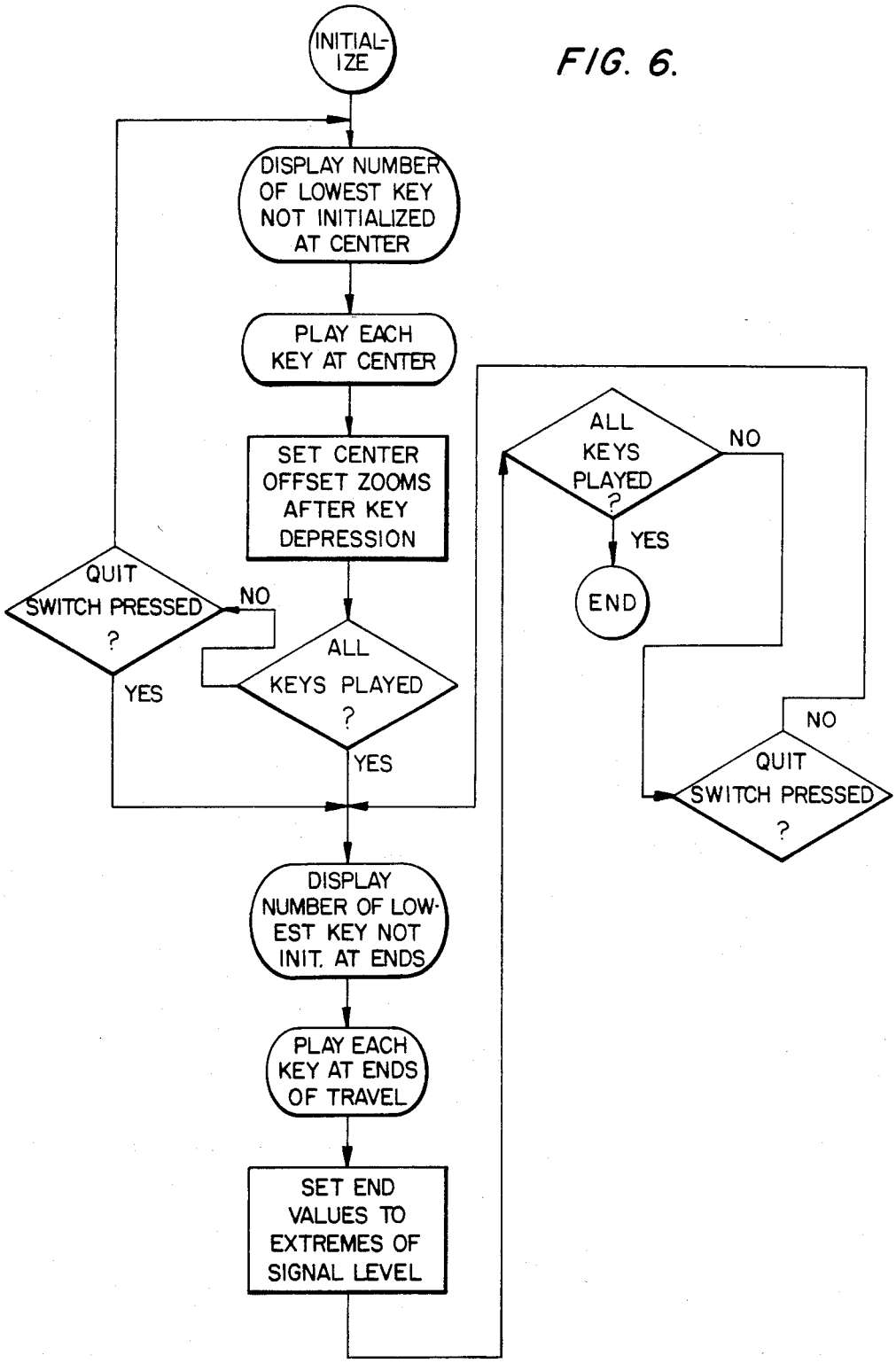
FIG. 6 is a flowchart diagram describing the initialization procedure for center compensation for individual players characteristics of key depression.

Another feature provided by the novel interrelationship between the pressure sensor and microprocessor unit, with longitudinal displacement signals as a control solves the problem of inadvertent key motion or improper longitudinal holding. Such a situation would exist when, for example, after a desired tone is produced, small variations in key motion—such as produced involuntarily by a player's fingers when other keys are moved—change the output tone from the desired tone. Two solutions, which are mutually compatable, allow the microprocessor unit, as a signal processing means, to interpret a particular longitudinal displacement as an attempt to reach the nearest semitone or other predefined tonal specification, such as a predetermined fixed pitch, and therefore providing signals to the tone generator to provide the nearest semitone. The second solution, which may be used in conjunction with the pitch fixing operation described above is the provision of a deadband or area of longitudinal motion where no tone variation occurs. In the deadband solution, an area is defined around the longitudinal position, after a sufficient time in that location has expired (such as a second) to ensure that the existing longitudinal position is the one desired and not simply one position in an active shifting of pitch, in which slight longitudinal displacement will result in the same tone produced. Specifically, in reference to FIG. 7, the curve K represents the distance of key displacement relationship to pitch variation as shown in FIGS. 3–5. The point L on curve K represents the tone-displacement position of the system after a specified time. Curve portion M represents the movable deadband area created by the microprocessor unit that brackets the point L such that small displacements of the key result in no tone or pitch variation. When the key is displaced out of the deadband region, or if the deadband parameter is turned off—such as by increased pressure retriggering of the key—the curve will return to a smooth directly proportional relationship without the imposed deadband.

Further modifications will also occur to those skilled in the art, and such are considered to fall within the spirit and scope of the invention as defined in the appended claims.

What is claimed is:

1. A keyboard-operated tone-producing apparatus having, in combination, keyboard means the keys of which are mounted for downward depression to effect tone production in the apparatus and for longitudinal sliding to alter or bend the tone; electronic digital signal processor means; tone-generating means; pressure sensing means responsive to key depression to produce signals corresponding thereto for application to the signal processor means to produce corresponding digital signals applied to generate tones from the tone-generating means; means for causing the pressure sensing means to provide the same signal reference, upon key depression, irrespective of the point of pressure along the path of longitudinal sliding of the key; and means controlled in response to the last-named means and cooperative with the signal processor means as it controls the tone-generating means to produce one or all of variable range bending of the tone, center compensation for differing player techniques of key depression, and second striking of the key while depressed for second tone generation.

2. An apparatus as claimed in claim 1 and in which the pressure sensing means provides a reference signal proportional to the pressure on the key.

3. An apparatus as claimed in claim 1 and in which the pressure-sensing means comprises capacitor means variable in response to depression of the key, with means provided responsive to a predetermined threshold of depression to represent the striking of the key.

4. An apparatus as claimed in claim 3 and in which means is provided responsive to a second or greater pressure on the key further to vary the capacitance of the capacitor means to generate a second signal representing said second striking.

5. An apparatus as claimed in claim 3 and in which the key depressing mechanism and the capacitor means are secured in the same position irrespective of longitudinal movement of the key.

6. An apparatus as claimed in claim 3 and in which the pressure sensing means comprises a rocker assembly connected to an electrically conductive leaf spring serving as one of the electrodes of said capacitor means and separated from but moveable by key depression towards another electrode, with dielectric therebetween.

7. An apparatus as claimed in claim 6 and in which the other electrode is resilient and of variable width facing the said one electrode to permit variable area of capacitance with increased pressure on the key.

8. An apparatus as claimed in claim 1 and in which the keys are further provided with longitudinal displacement sensor means for producing further signals corresonding to the longitudinal displacement of the key, and means for applying the same to said signal processor means further to control the tone-generating means to change the pitch of the tone in predetermined range in a rising or falling manner as the longitudinal sliding movement of the key is effected toward or away from the player, resulting in said note-bending of the tone.

9. An apparatus as claimed in claim 1 and in which means is provided for adjusting the displacement sensor means to accommodate for different player key depression characteristics by adjusting the effective center position of player key contact.

10. An apparatus as claimed in claim 8 and in which means is provided for compensating for inadvertent longitudinal sliding of the key during depression.

11. An apparatus as claimed in claim 1 and in which means is provided for enabling the same tone generation from the tone-generating means upon relatively rapid release of the depressed key as if the key remained depressed, while enabling longitudinal sliding note-bending displacement of the key during relatively slow release of the depressed key.

12. An apparatus as claimed in claim 8 and in which means associated with the signal processor means is provided for responding to a particular degree of longitudinal sliding displacement of a key to continue the tone-generating means to generate the nearest predetermined fixed pitch.

13. An apparatus as claimed in claim 8 and in which means is provided for providing a deadband of tone variation by the tone-generating means for a limited range of longitudinal sliding displacement of a key.

* * * * *